US005788810A

United States Patent [19]

Bielfeldt

[11] Patent Number: 5,788,810

[45] Date of Patent: Aug. 4, 1998

[54] CONTINUOUSLY OPERATING PRESS

[75] Inventor: Friedrich B. Bielfeldt, Paehl, Germany

[73] Assignee: Machinenfabrik J. Diefenbacher GmbH & Co., Eppingen, Germany

[21] Appl. No.: 867,625

[22] Filed: Jun. 2, 1997

[30] Foreign Application Priority Data

Jun. 3, 1996 [DE] Germany ..... 1 96 22 213.3

[51] Int. Cl.[6] ..... B30B 5/06

[52] U.S. Cl. ..... 156/583.5; 156/555; 100/311; 100/154; 425/371

[58] Field of Search ..... 156/555, 580, 156/583.1, 583.5; 425/371; 100/311, 154

[56] References Cited

U.S. PATENT DOCUMENTS

| | | | |
|---|---|---|---|
| 4,468,188 | 8/1984 | Gerhardt et al. | 425/371 |
| 4,645,632 | 2/1987 | Bottger et al. | 100/154 |
| 4,909,719 | 3/1990 | Bielfeldt | 425/186 |
| 5,112,431 | 5/1992 | Gerhardt et al. | 156/583.5 |
| 5,182,986 | 2/1993 | Bielfeldt | 100/151 |
| 5,193,451 | 3/1993 | Sitzler et al. | 100/154 |
| 5,253,571 | 10/1993 | Bielfeldt et al. | 100/41 |
| 5,323,696 | 6/1994 | Bielfeldt et al. | 100/154 |
| 5,333,541 | 8/1994 | Bielfeldt et al. | 100/41 |
| 5,537,919 | 7/1996 | Bielfeldt et al. | 100/311 |
| 5,562,028 | 10/1996 | Bielfeldt et al. | 100/311 |

*Primary Examiner*—James Sells
*Attorney, Agent, or Firm*—Foley & Lardner

[57] ABSTRACT

A continuously operating press includes a press ram, a press table, flexible, endless steel bands which draw in a pressable material and transmit press pressure to the pressable material, drive and, deflecting rollers for guiding the steel bands around the press table and the press ram, upper and lower heating plates disposed between the press ram and the press table and between which a press nip is defined, and press cylinder-piston arrangements for adjusting the press nip. Tensioning brackets which are connected to the press table have openings within which the press cylinder-piston arrangements are received. Further, short-stroke cylinder-piston arrangements are arranged transversely with respect to the pressing path and beneath the lower press heating plate to permit a concave or convex deformation in the transverse direction.

25 Claims, 6 Drawing Sheets

CONTINUOUSLY OPERATING PRESS

BACKGROUND OF THE INVENTION

1. Field of the Invention

The invention relates to a continuously operating press for producing particleboards, fiberboards or similar wooden-material boards and plastic sheets and, more particularly to a continuously operating press for achieving large deformation gradients in the longitudinal and transverse directions.

2. Description of the Related Art

A continuously operating press is disclosed in DE-C 40 17 791. In the continuously operating press according to DE-C 40 17 791, a steel-band adjustment can be realized during operation with respect to the longitudinal center axis without the steel bands expanding excessively on one side. Further, the continuously operating press according to DE-C 40 17 791 provides a vertical, elastic connection of the individual beams with respect to one another, in order to allow control of an asymmetric pressure profile on the press heating plates, to thereby permit asymmetric deformation of the press heating plates. In practice, the solution provided for this purpose has proved to be workable.

However, the continuously operating press according to DE-C 40 17 791 has a disadvantage in that the transverse, and in particular the longitudinal bending deformation of the press heating plates in the decompression part and compression part of the press, as is required in the production of fiberboards (MDF), cannot be made large enough, because tensioning brackets are arranged outside the main press cylinder to permit the fastening of the tensioning brackets to the upper stationary crosshead in the tensioning-frame press column by means of pins or bolts. This results in a relatively large support spacings of the force-transmitting web plates of the press ram and the press table with respect to the elastically deformable upper and lower press heating plates.

Further, since the short-stroke cylinders are arranged beneath the lower press heating plate, in a transverse direction with respect to the longitudinal center axis, and rowwise inside the tensioning-frame press column, another disadvantage is that the force-transmitting web plates from the upper press ram onto the steel bands are only supported centrically in the support spacing between these web plates by means of the hydraulic short-stroke cylinders in the press table.

Because of the centrically-arranged supporting and the relatively large support spacings caused by the upper tensioning-bracket fastening, relatively large plate thicknesses are required for the flexural support of the upper and lower press heating plates. This places limitations on a relatively high flexible deformation of the press heating plates, both transversely and longitudinally. In other words, with a press in accordance with DE-C 40 17 791, a longitudinal and transverse deformation gradient of only 2 mm/m is possible longitudinally and transversely without damaging the structural parts.

SUMMARY OF THE INVENTION

An object of the invention is to provide a continuously operating press that achieves a closer supporting of forces, and hence a higher force density and better hydroelastic introduction of forces onto the press heating plates and the steel bands of the press table and the press ram.

Another object of the invention is to provide a continuously operating press that permits a greater longitudinal deformation at the top of the press heating plates and a greater transverse deformation at the bottom of the press heating plates.

The above and other objects are accomplished by a continuously operating press having a press ram, a press table, flexible, endless steel bands which draw in a pressable material and transmit press pressure to the pressable material, drive and deflecting rollers for guiding the steel bands around the press table and the press ram, upper and lower heating plates disposed between the press ram and the press table and between which a press nip is defined, and press cylinder-piston arrangements for adjusting the press nip. Tensioning brackets which are connected to the press table have openings within which the press cylinder-piston arrangements are received. Further, short-stroke cylinder-piston arrangements are arranged transversely with respect to the pressing path and beneath the lower press heating plate to permit a concave or convex deformation in the transverse direction.

Additional objects, features and advantages of the invention will be set forth in the description of preferred embodiments which follows.

BRIEF DESCRIPTION OF THE DRAWINGS

Further features and advantages of the invention emerge from the subclaims and from the following description of an exemplary embodiment with reference to the drawing, in which:

Figure 1:
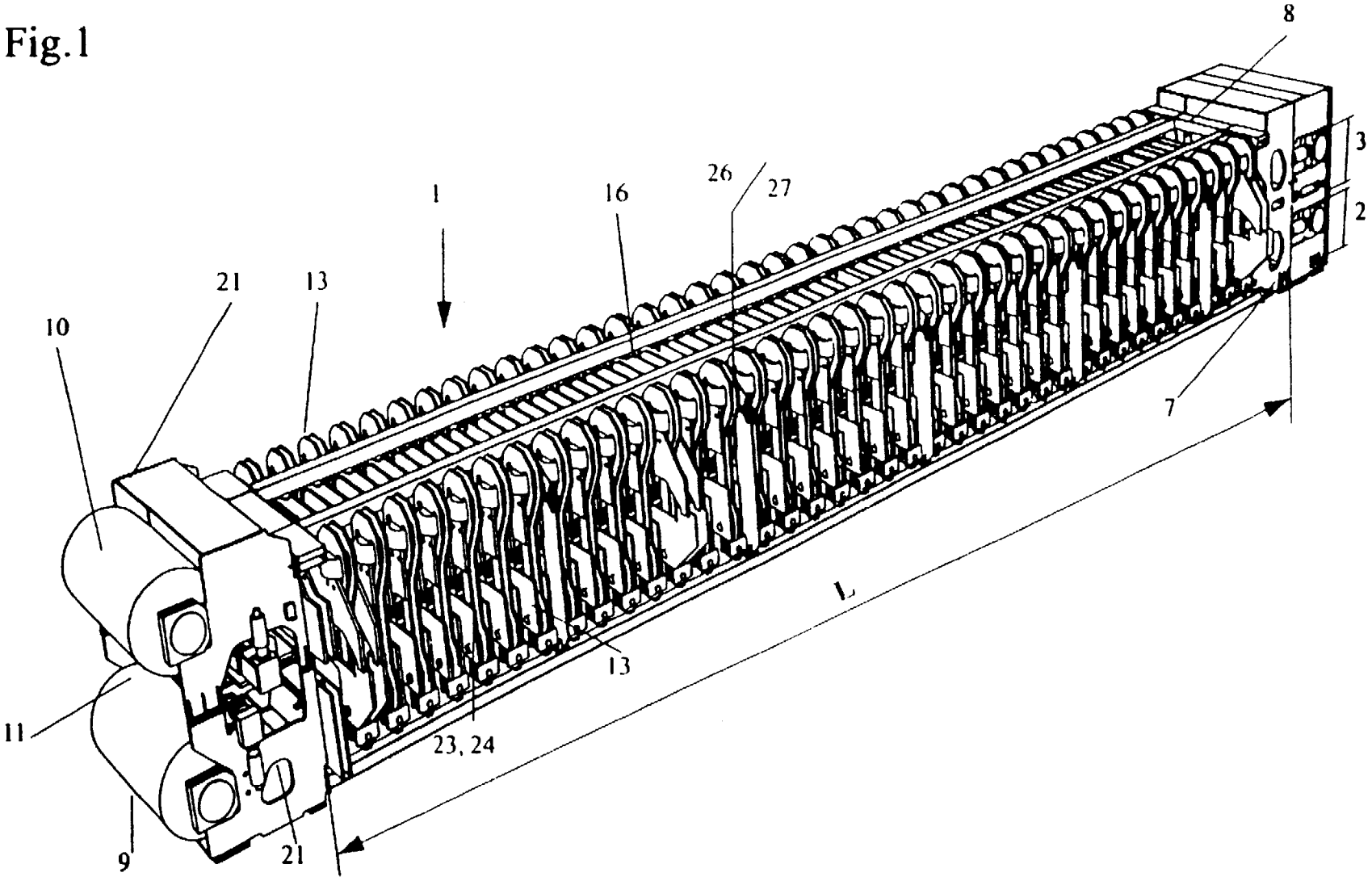
FIG. 1 shows a perspective representation of a continuously operating press according to the invention.

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

Detailed Description of the Preferred Embodiment

In the continuously operating press according to the invention, the main press cylinders are arranged closer together to achieve a closer supporting of forces of the upper and lower press heating plates. The main press cylinders are arranged closer together through a novel upper tensioning-bracket fastening. Consequently, the press cylinders can be placed directly adjacent to one another, as a result of which a higher force density, a geometrically improved introduction of forces, and a greater press heating plate deformation are permitted both at the top and at the bottom.

Due to the drastic reduction in the support spacings in accordance with the invention, by means of the functional separation between the longitudinal deformation of the upper press heating plate and the transverse deformation of the lower press heating plate, the deformation gradient can be increased by about 1000%, to about 4 mm/m longitudinally at the top and transversely at the bottom. As a result, new technical applications can be utilized.

Thus, due to these greater deformabilities, it is possible, even with plate thicknesses which vary considerably, to produce economically, for example in the field of lightweight-fiberboard production, boards with apparent densities of ≦500 kg/m$^3$ with physically greater in-use strengths, such as, for example, increased transverse tensile strengths, compared to particleboards with apparent densities of about 650 kg/m$^3$. Saving wood resources will become increasingly advantageous from an environmental and economic viewpoint.

For the transverse deformation of the lower press heating plate, the lower short-stroke cylinders in the tensioning-frame press column are arranged on the lower web plates of the press table such that the hydraulic forces are introduced transversely, distributed at least over four force points, congruently with respect to the support spacing of the upper web plates of the press ram. As a result, the dimensioning of the lower press heating plate is subject to the same dimensioning rule as the top one, and by means of this hydroelastic multipoint support, it is possible to elastically iron out different distributions in density of the material to be pressed resulting from scatter errors, in particular in the production of thin boards, thus protecting the steel bands with their rolling support to reduce the cost-intensive wear which is present there and to thereby bring about a longer service life.

Due to the new arrangement of the main press cylinders within the tensioning-bracket openings at the top, closer support spacings and a larger number of tensioning-frame press columns are possible with uniform spacings of the framework web plates at the top on the pressing path. On the press ram, the main press cylinders are surrounded on all sides by the novel tensioning brackets with a virtually central introduction of forces into the plunger pistons, so that the plunger pistons can follow the deformation of the upper press heating plates in a hydraulically flexible manner, and a longitudinal deformation of about 4 mm/m of the upper press heating plates can be achieved even at the start of the first tensioning-frame press column.

By combining this with the entry system in accordance with DE-A 43 01 594, the contents of which are incorporated by reference herein, in which the entry angles at the top are controlled by means of joints and the hydraulic actuating forces are taken up longitudinally without transverse bending forces, the transverse deformation at the bottom can be controlled without limitation. Thus, the short-stroke cylinder rows can be used for an optimum transverse tensile strength of the finished material to be pressed even from the first individual framework, so that a transverse deformation of the lower press heating plate can be used directly after the entry system.

Due to the more flexible action in accordance with the invention of the short-stroke cylinders on the material to be pressed, the supply of thermal energy and thus the formation of steam pressure can preferably be influenced favorably in the front region of the pressing path, as a result of which it is possible to set higher production rates. Due to the arrangement of the tensioning brackets within the webs of press ram and press table, respectively, the spacings of the web plates in their assignment to the press cylinder bodies can be arranged at a more even spacing.

For the upper arrangement of the press cylinders, which are arranged close together because of the necessary force density with respect to the press surface, the support spacing with respect to the press surface from center to center of these press cylinders is only half as large, thus resulting in a relatively narrow supporting of forces in the introduction of the press forces to the lower and upper press heating plates. This reduction results in an advantageous dimensioning rule for the support spacings, which depending on the introduction of the press forces are in the range between 400 mm and 500 mm, and the possible thickness of the press heating plate is designed to be in the range from 75 mm to 90 mm.

Short-stroke cylinders with an operative stroke of about 10 mm are used for the hydraulic multipoint support at the bottom, two configurations being used for the supporting of forces, congruently with respect to the support spacing of the upper web plates. By means of the supporting of the short-stroke plunger pistons on the lower web plates of the press table, the short-stroke cylinders can be supported against the lower press heating plate.

In the hydraulically unpressurized state, the lower press heating plate is pulled concavely downwards by about 2 mm by means of a resilient return, which is installed for each press column. In the hydraulically activated state, the press heating plate can be bent convexly upwards by up to 8 mm, so that, depending on the steel-band speed, the technical requirements in the front high-pressure region can be adjusted for a production of thick or thin boards and the precise calibration can be set in the rear third of the pressing path.

In one embodiment, the pressure-exerting surfaces of the short-stroke cylinders are of rectangular design, so that their rectangular sides can be arranged transversely with respect to the direction of transportation at a spacing from one another such that, due to projections on these edges, for every four support bars a supporting spacing can be provided which is equal to the supporting spacing of the upper web plates of the press ram. The support on the lower press heating plate by means of these support bars transversely with respect to the direction of transportation is effected via strips of insulating material, so that the heated lower press heating plate is insulated in terms of heat from the hydraulic short-stroke cylinders.

By assigning two to four short-stroke cylinders per tensioning-frame press column, with direct support of the short-stroke plunger pistons on the web plates of the press table and division of the short-stroke cylinder surface over four support bars per short-stroke cylinder, an effect is achieved which is similar to that of a multiple number of cylinders. All the short-stroke cylinders, both the upper press main cylinders with an operative stroke of about 100 mm and the lower short-stroke cylinders for the transverse deformation with an operative stroke of about 10 mm, are equipped with a sealing system, which permits a tilting movement of the plunger pistons of about 0.4°, so that the deformations of the upper and lower press heating plates can be adjusted without additional support of cylinder and plunger by means of universal joints.

Figure 2:
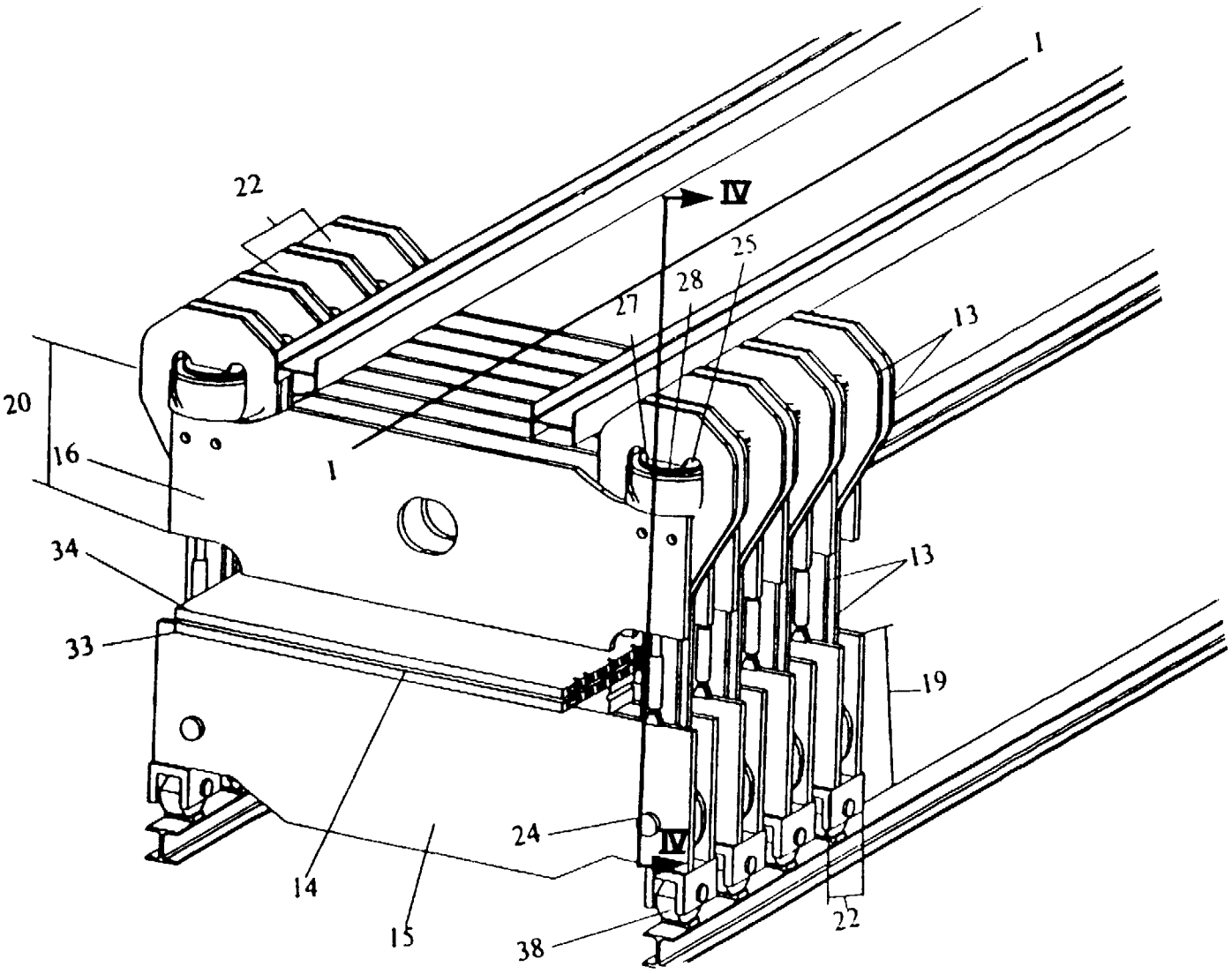
FIG. 2 shows the front part of the continuously operating press, without deflecting rollers and steel bands, in accordance with FIG. 1 but on a larger scale.

The continuously operating press 1 according to the invention, shown in FIGS. 1 and 2 without steel bands 5 and 6 and without roll bars 12, comprises, as its main components, a press table 2 and a vertically movable press ram 3, and tensioning brackets 13 connecting them in a positively locking manner. The tensioning brackets 13 can be released quickly from the press table 2 by means of bolts 24. Entry crossbeams 21 are arranged at end sides of the press table 2 and the press ram 3 and serve as anchoring and bearing location for drive rollers 7 and 8, deflecting rollers 9 and 10, and entry systems (not shown) for the roll bars 12.

The press table 2 and the press ram 3 comprise lower web plates 15 and upper web plates 16 and transverse ribs 18 connecting the web plates together. Two upper web plates 16 and two lower web plates 15, together with the tensioning brackets 13, form a press column 22. When the web plates 15 and 16 and the tensioning brackets 13 of the press column 22 are placed next to one another and lower and upper press heating plates 33 and 34 are mounted thereto, the continuously operating press 1 of a pressing length L is formed.

The tensioning brackets 13 are fixed on the press table 2 by means of the bolts 24 which are anchored in eyelets 23 of the tensioning brackets 13 and the lower web plates 15. The lower press table 2 comprises a plurality of individual beams 19 (table module), and the press ram 3 comprises a plurality of individual beams 20 (press ram module). The shoulders or protrusions projecting out of the web plates 16 on the left and right act as abutments for raising and lowering the press ram 3 and press cylinder-piston arrangements 26/27 are arranged in openings 25 in the tensioning brackets 13.

It can further be seen from FIG. 1 how the deflecting rollers 9 and 10 form an entry nip 11. The roll bars 12, which are guided with the steel bands 5 and 6 around the press table 2 and the press ram 3, are supported against the press heating plates 33 and 34. In other words, the revolving roll bars 12, as an example of a rolling support, are arranged between the press heating plates 33 and 34 and the steel bands 5 and 6 so as to roll along with them. The material 4 to be pressed is drawn through the press nip 11 together with the steel bands 5 and 6, which are driven by the drive rollers 7 and 8, and is pressed into boards. Hydraulic short-stroke cylinders 29 are arranged, with short-stroke plunger pistons 30, beneath the lower press heating plate 33 and are supported on two of the lower web plates 15.

In accordance with FIGS. 2, 3, 4 and 5, the openings 25 in the tensioning brackets 13 fastened on the press ram 3 are designed to be of such a size that in each case one or more tensioning brackets 13 per longitudinal side receive the press cylinders 26 with the plunger pistons 27 such that the one or more tensioning brackets 13 encircle the press cylinders 26 and the plunger pistons 27, thereby forming a modular press column 22 or individual framework 22 with the two web plates 15 and 16 and the transverse ribs 18.

The tensioning brackets 13, with upper opening faces 28 of the openings 25, are supported against the plunger pistons 27, the movement of which adjusts the press nip. The press cylinders 26 are supported against the upper web plates 16 so that an inflow of hydraulic fluid into the press cylinders 26 cause a downward movement of the press cylinders 26, the upper web plates 16, and the upper press heating plates 34, and an upward movement of the tensioning brackets 13, the lower web plates 15, and the lower press heating plates 33. The tensioning brackets 13 are preferably arranged within the two lower and upper web plates 15 and 16 (see FIG. 4).

It is envisaged, as an expedient dimensioning rule for the structural parts of the continuously operating press 1, to design the thickness of the press heating plates 33 and 34 to be between 75 and 90 mm and to arrange the web plates 15 and 16 with a supporting spacing e of between 400 mm and 500 mm.

For a further expedient configuration of the continuously operating press 1, the faces of the shortstroke cylinders 29 are provided with, in each case, four rectangular support bars 31. The support bars 31 of the short-stroke cylinders 29 acts along two support lines arranged transverse to the longitudinal center axis of the lower press heating plate 33 and are arranged to be aligned with the end faces of the web plates 15 and 16, so that they have the same supporting spacing e on the lower press heating plate 33 as the web plates 16 on the upper press heating plate 34. For the purpose of heat insulation and protection of the short-stroke cylinders 29, the contact surfaces of the support bars 31 on the lower press heating plate 33 are provided with an insulating strip 32.

Figure 3:
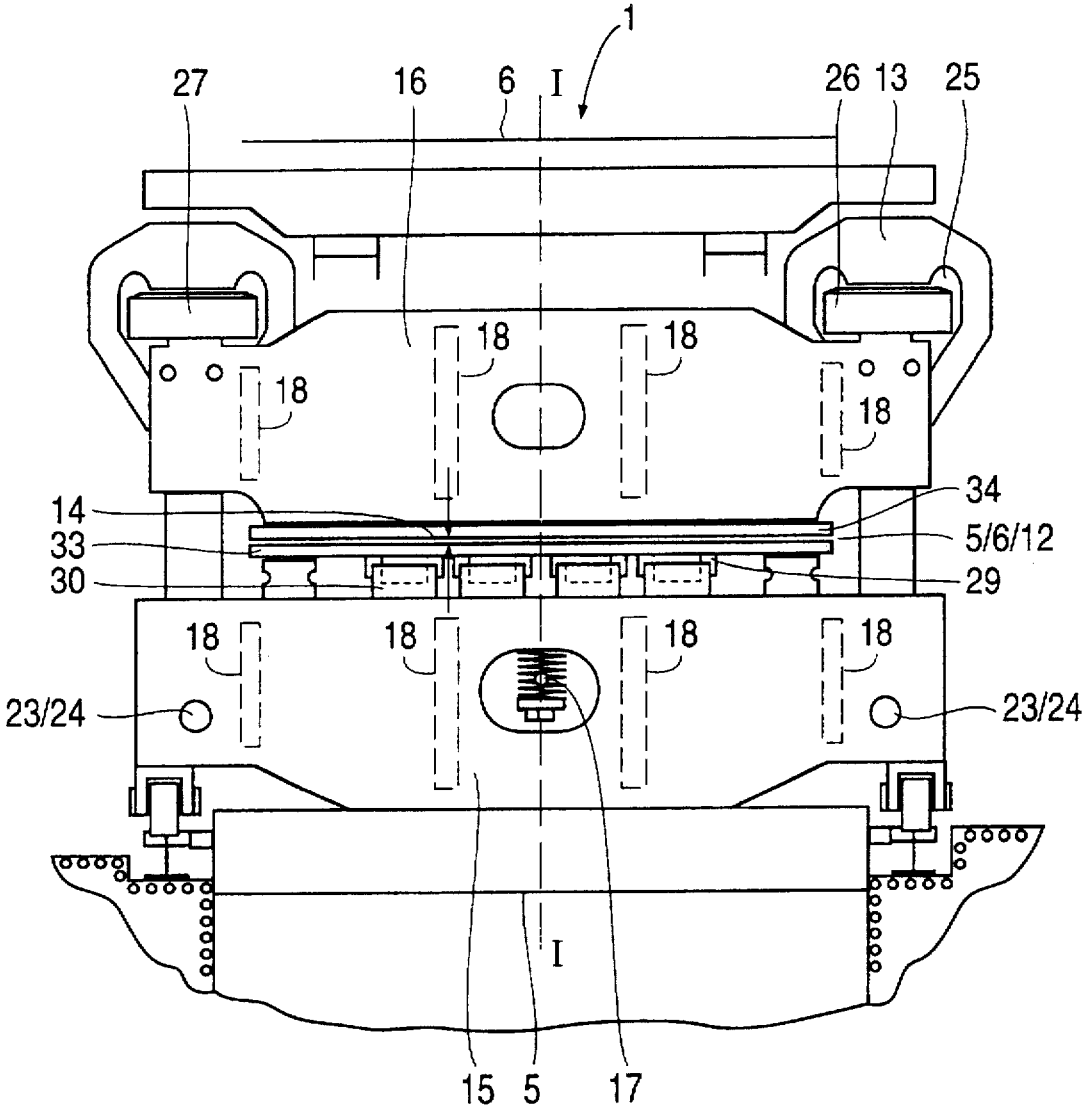
FIG. 3 shows a front view of the continuously operating press in accordance with FIG. 2.
Figure 4:
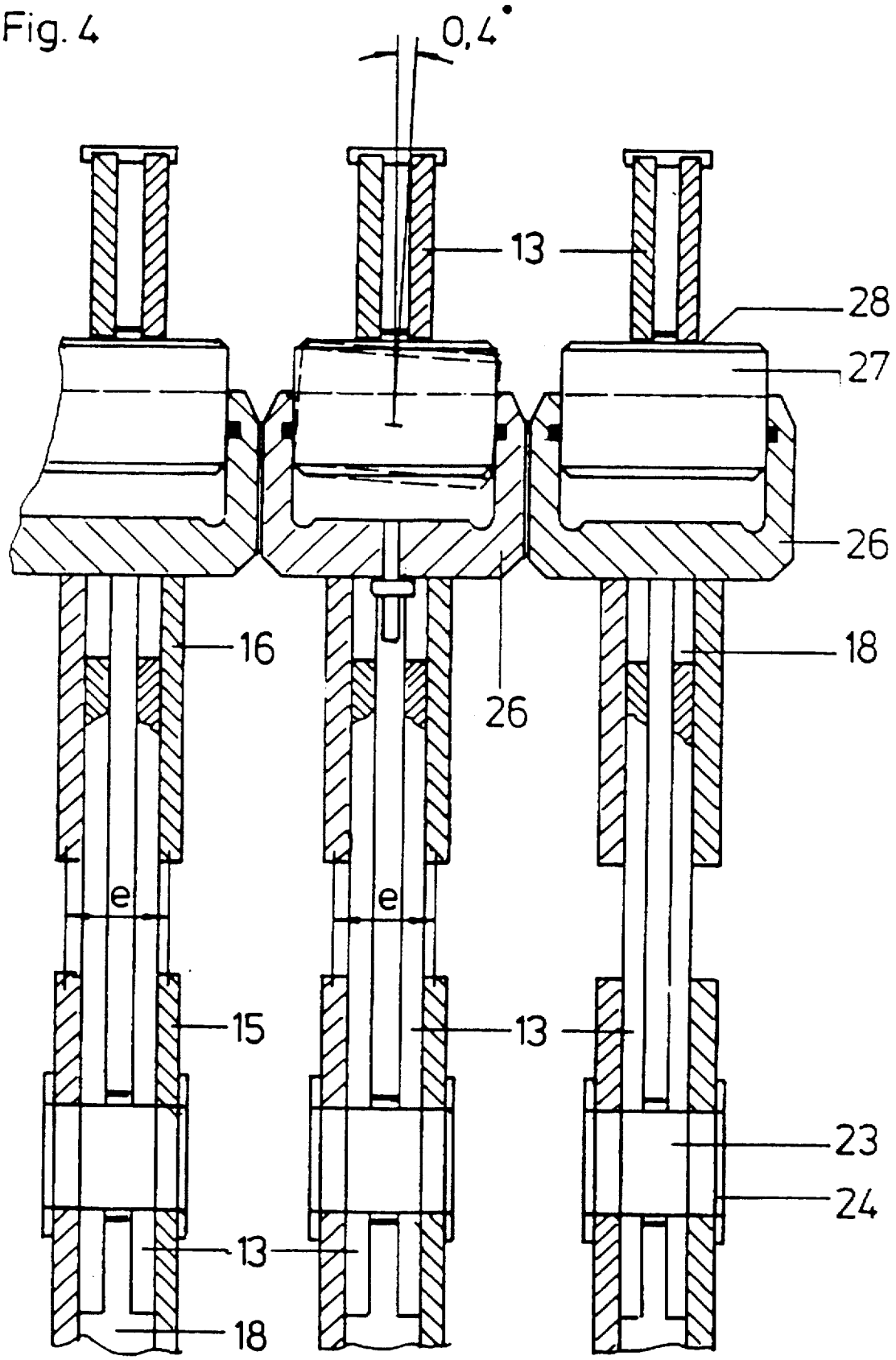
FIG. 4 shows a cross sectional view of a press column taken along line IV—IV in accordance with FIG. 2.
Figure 5:
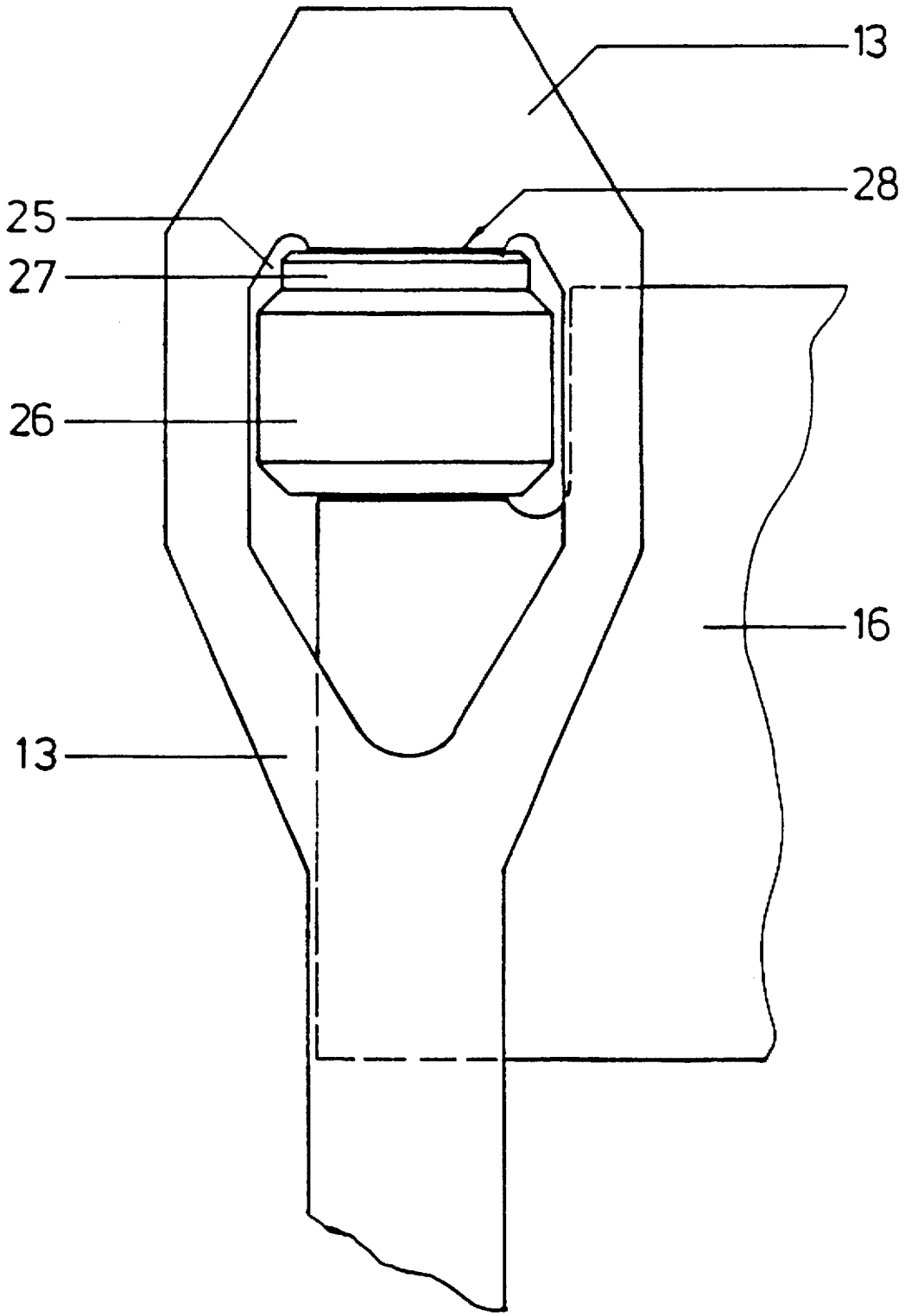
FIG. 5 shows the design of the upper part of a tensioning bracket of the continuously operating press.
Figure 8:
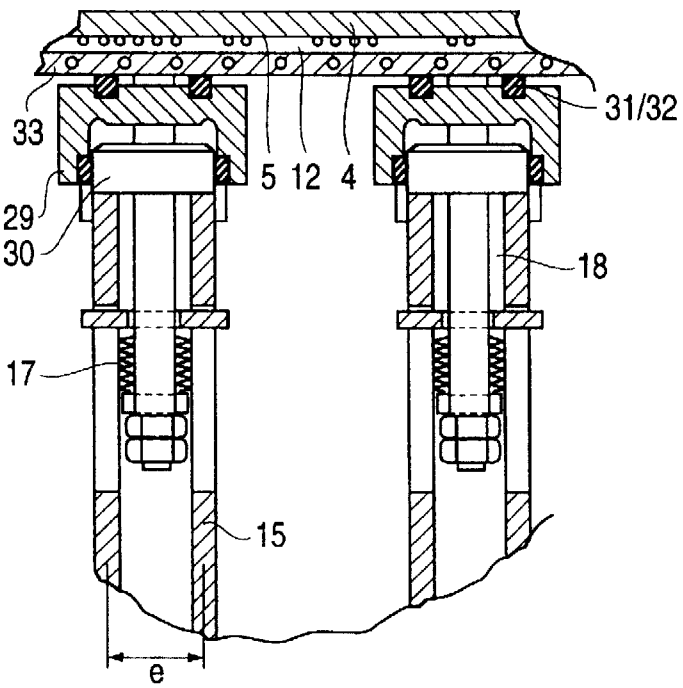
FIG. 8 shows a side view of the arrangement in accordance with FIG. 6.
Figure 6:
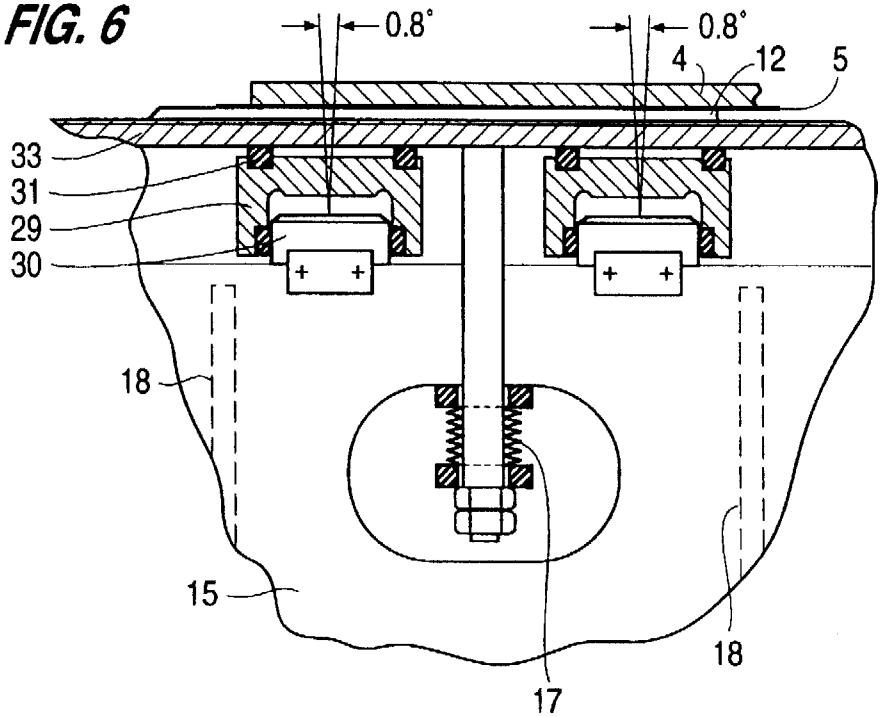
FIG. 6 shows, in section, the arrangement of the short-stroke cylinders with respect to the lower press heating plate of the continuously operating press.
Figure 7:
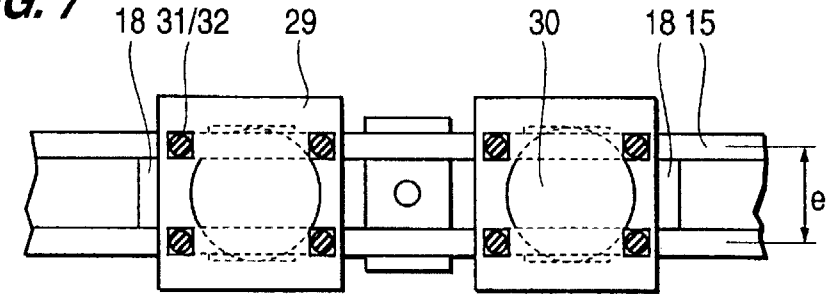
FIG. 7 shows a top view of the arrangement in accordance with FIG. 6.

The concave deformability of the lower press heating plate 33 by means of a return spring 17 is illustrated in FIG. 3. By means of the return spring 17, the lower press heating plate 33 can be bent downwards by about 2 mm in the hydraulically unpressurized state, while in the hydraulically activated state, it can be bent convexly upwards by up to 8 mm. The return springs 17 are expediently each arranged between the two lower web plates 15 of the press column 22 or the individual framework 22 and are fixed in the press heating plate 33.

While particular embodiments according to the invention have been illustrated and described above, it will be clear that the invention can take a variety of forms and embodiments within the scope of the appended claims.

The contents of DE 1 96 22 213.3, filed Jun. 3, 1996, are incorporated by reference herein.

What is claimed is:

1. A continuously operating press comprising:

upper and lower press heating plates between which a press nip is defined;

an upper web plate connected to the upper press heating plate;

a lower web plate connected to the lower heating plate;

a tensioning bracket connected to the lower web plate; and a press cylinder-piston arrangement, operably connected to the upper and lower web plates, for adjusting the press nip, wherein the tensioning bracket has an opening within which the press cylinder-piston arrangement is received.

2. The press according to claim 1, wherein two tensioning brackets are respectively connected to either ends of the lower web plate and two press cylinder-piston arrangements are respectively received in openings formed in the two tensioning brackets.

3. The press according to claim 1, wherein the press cylinder-piston arrangement includes a piston and a cylinder body.

4. The press according to claim 3, wherein the opening of the tensioning bracket comprises a through hole formed in the tensioning bracket.

5. The press according to claim 4, wherein the tensioning bracket has an extension at a top portion of the through-hole, the extension being supported against a top face of the piston.

6. The press according to claim 5, wherein a bottom face of the cylinder body is supported against the upper web plate.

7. A continuously operating press, comprising:

a press ram including a plurality of upper individual beams elastically connected to one another;

a press table including a plurality of lower individual beams elastically connected to one another;

flexible, endless steel bands which draw in a pressable material and transmit press pressure to the pressable material;

drive and deflecting rollers for guiding the steel bands around the press table and the press ram;

upper and lower heating plates disposed between the press ram and the press table and between which a press nip is defined;

press cylinder-piston arrangements for adjusting the press nip; and tensioning brackets connected to the press table and having openings within which the press cylinder-piston arrangements are received.

8. The press according to claim 7, wherein the lower individual beams of the press table and the tensioning brackets include corresponding eyelets into which bolts are received to connect the lower individual beams to the tensioning brackets.

9. The press according to claim 7, wherein each upper individual beam includes an upper web plate and each lower individual beam includes a lower web plate.

10. The press according to claim 9, wherein each press cylinder-piston arrangement includes a piston and a cylinder body.

11. The press according to claim 10, wherein the opening of each tensioning bracket comprises a through-holes formed in the tensioning bracket.

12. The press according to claim 11, wherein each tensioning bracket has an extension at a top portion of the through-hole, the extension being supported against a top face of the piston of the respective press piston-cylinder arrangement.

13. The press according to claim 10, wherein a bottom face of the cylinder body is supported against the upper web plate of the respective upper individual beam.

14. The press according to claim 7, wherein each upper individual beam includes a pair of upper web plates and each lower individual beam includes a pair of lower web plates.

15. The press according to claim 14, wherein each tensioning bracket is arranged between the pair of upper web plates of the respective upper individual beam and between the pair of lower web plates of the respective lower individual beam.

16. The press according to claim 14, wherein a thickness of the upper and lower press heating plates is between 75 and 90 mm, and a spacing between the pair of upper and lower web plates is between 400 mm and 500 mm.

17. A continuously operating press comprising:

upper and lower press heating plates between which a press nip is defined;

an upper web plate connected to the upper press heating plate;

a lower web plate connected to the lower heating plate;

a short-stroke cylinder-piston arrangement including a cylinder body and a piston, the piston being supported against the lower web plate and the cylinder body being supported against the lower press heating plate; and a spring elastically connecting the lower press heating plate to the lower web plate.

18. The press according to claim 17, wherein two short-stroke cylinder-piston arrangements are arranged transversely with respect to the lower heating plate and on either side of the spring, and wherein a concave or convex transverse deformation of the lower press heating plate can be adjusted by an actuation of the two short-stroke cylinder piston arrangements by about −2 mm to +8 mm.

19. The press according to claim 18, wherein the cylinder body includes rectangular support bars against which the lower press heating plate are supported.

20. The press according to claim 19, wherein the rectangular support bars are provided with insulating strips.

21. The press according to claim 20, further comprising press cylinder-piston arrangements, operably connected to the upper and lower web plates, for adjusting the press nip, wherein an adjustment of the press nip is independent of the transverse deformation by the short-stroke cylinder-piston arrangements.

22. The press according to claim 21, wherein the transverse deformation by the short-stroke cylinder-piston arrangements is effected via at least four force points per short-stroke cylinder.

23. The press according to claim 22, wherein pistons of the press cylinder-piston arrangements have an operative stroke of about 100 mm, with a virtually central introduction of forces onto the upper and lower heating plates and with a possible tilting movement of 0.40°.

24. The press according to claim 23, wherein the piston of the short-stroke piston-cylinder arrangement has an operative stroke of about 10 mm and with a possible tilting movement of 0.40°.

25. The press according to claim 24, wherein a deformation gradient of up to 4 mm/m is achieved throughout an entire pressing length.

* * * * *

UNITED STATES PATENT AND TRADEMARK OFFICE

CERTIFICATE OF CORRECTION

PATENT NO. : 5,788,810

DATED : August 4, 1998

INVENTOR(S) : Friedrich B. BIELFELDT

It is certified that error appears in the above-identified patent and that said Letters Patent is hereby corrected as shown below:

Title page Assignee [73] contains a typographical error wherein "Machinenfabrik J. Diefenbacher GmbH & Co." should read --Machinenfabrik J. Dieffenbacher GmbH & Co.--.

Signed and Sealed this

Fourth Day of January, 2000

*Attest:*

*Attesting Officer*

*Acting Commissioner of Patents and Trademarks*